US006394188B1

(12) United States Patent
Zwergel

(10) Patent No.: US 6,394,188 B1
(45) **Date of Patent: *May 28, 2002**

(54) VEHICULAR FIRE EXTINGUISHING DEVICE

(75) Inventor: James C. Zwergel, Murrysville, PA (US)

(73) Assignee: Fire Safety Products, Inc., Pittsburgh, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/567,788

(22) Filed: May 9, 2000

Related U.S. Application Data

(63) Continuation-in-part of application No. 08/921,143, filed on Aug. 29, 1997, now Pat. No. 6,076,610.

(51) Int. Cl.[7] ..... A62C 35/58

(52) U.S. Cl. ..... 169/85; 169/62; 169/73; 169/75

(58) Field of Search ..... 169/85, 73, 75, 169/71, 62; 222/95, 107, 105

(56) References Cited

U.S. PATENT DOCUMENTS

| | | | | | |
|---|---|---|---|---|---|
| 2,346,183 | A | * | 4/1944 | Paulus et al. | 169/73 |
| 2,557,162 | A | * | 6/1951 | Wetzel et al. | 169/73 |
| 3,713,493 | A | * | 1/1973 | Hansen | 169/75 |
| 4,732,299 | A | * | 3/1988 | Hoyt et al. | 222/107 |
| 4,779,683 | A | * | 10/1988 | Enk | 169/62 |
| 4,813,487 | A | * | 3/1989 | Mikulec | 169/73 |
| 4,889,189 | A | * | 12/1989 | Roznieck | 169/73 |
| 5,063,998 | A | * | 11/1991 | Quinn | 169/73 |
| 5,102,010 | A | * | 4/1992 | Osgar et al. | 222/107 |
| 5,555,940 | A | * | 9/1996 | Fujiki | 169/60 |
| 5,650,180 | A | * | 7/1997 | Kumada et al. | 222/105 |
| 5,676,190 | A | * | 10/1997 | Matsumoto et al. | 169/71 |
| 6,076,610 | A | * | 6/2000 | Zwergel | 169/73 |

OTHER PUBLICATIONS

Prior experimental non–commercial, non–public use; Sep. 24, 2001, 3 pages.*

* cited by examiner

*Primary Examiner*—Henry C. Yuen
*Assistant Examiner*—Dinh Q. Nguyen
(74) *Attorney, Agent, or Firm*—Sand & Sebolt

(57) ABSTRACT

A fire extinguishing or suppressing device having a rigid vessel with an interior space and an exit. An unexpandable flexible bladder is positioned in the interior space of the rigid vessel forming a space between the flexible bladder and the rigid vessel. A fire extinguishing composition is contained within the flexible bladder; and a pressurized gas is interposed between the rigid vessel and the flexible bladder.

47 Claims, 5 Drawing Sheets

VEHICULAR FIRE EXTINGUISHING DEVICE

CROSS REFERENCE TO RELATED APPLICATION

This is a continuation-in-part of U.S. Application Serial No. 08/921,143 filed Aug. 29, 1997, now U.S. Pat. No. 6,076,610.

BACKGROUND OF THE INVENTION (1) Field of the Invention

The present invention relates to fire extinguishing and suppressing devices and more particularly to fire extinguishing and suppressing devices for use in vehicles.

(2) Brief Description of Prior Art

In the prior art various types of fire extinguishing devices have been used in vehicles, particularly in industrial, military and racing vehicles. Because of increasing consumer demand for improved safety features, there has also recently been greater interest in using such fire extinguishing devices in passenger vehicles. An impediment, however, to the development of vehicular fire extinguishing systems has developed due to regulatory limits on the use of HALON and other similar fire extinguishing compositions. A need exists, therefore, for a fire extinguishing device which may be effectively activated in response to a vehicular fire and which effectively extinguishes fires without the use of HALON or other similar compositions.

SUMMARY OF THE INVENTION

The vehicular fire extinguishing or suppressing device of this invention comprises a pressurized vessel which contains a fire extinguishing composition and which has a fire extinguishing exit means. The vessel includes a means for retaining the fire extinguishing composition in the vessel and a means for deactivating the means for retaining the fire extinguishing composition in the vessel in response to a sensing of a fire in the vehicle in which the device is used.

The invention also encompasses a fire extinguishing or suppressing device that has a rigid vessel having an interior space and an exit. An unexpandable flexible bladder is positioned in the interior space of the rigid vessel forming a space between the flexible bladder and the rigid vessel. A fire extinguishing composition is contained within the flexible bladder; and a pressurized gas is interposed between the rigid vessel and the flexible bladder.

BRIEF DESCRIPTION OF THE DRAWINGS

Other objects, features and advantages of the present invention will become apparent upon reference to the following description of the preferred embodiments and to the drawings, wherein.

DETAILED DESCRIPTION OF THE DRAWINGS

Figure 1:
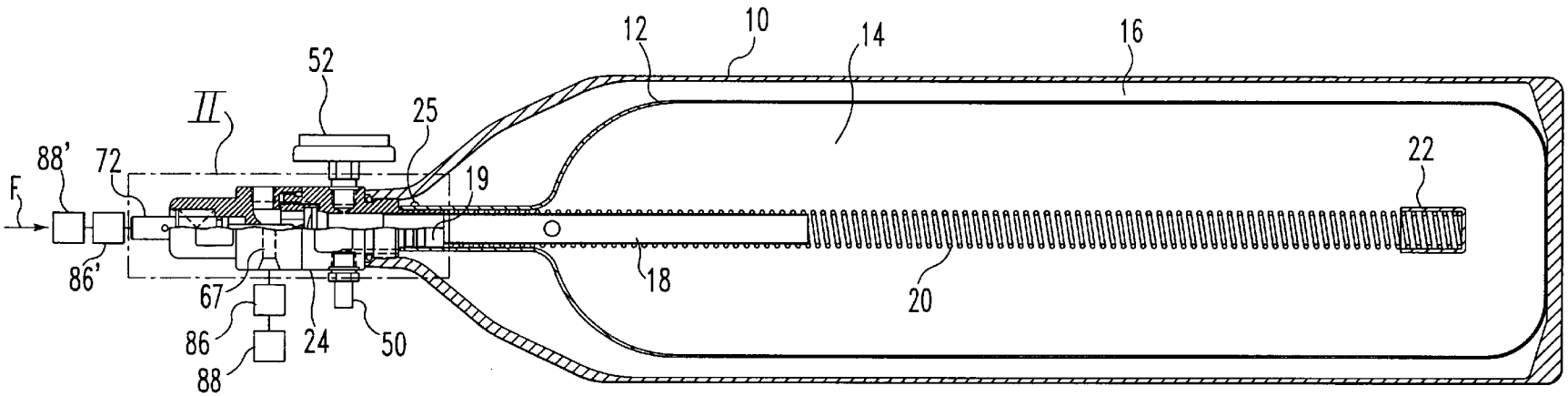
FIG. 1 is a front elevational view substantially in cross-section of a preferred embodiment of a fire extinguishing device of the present invention.
Figure 2:
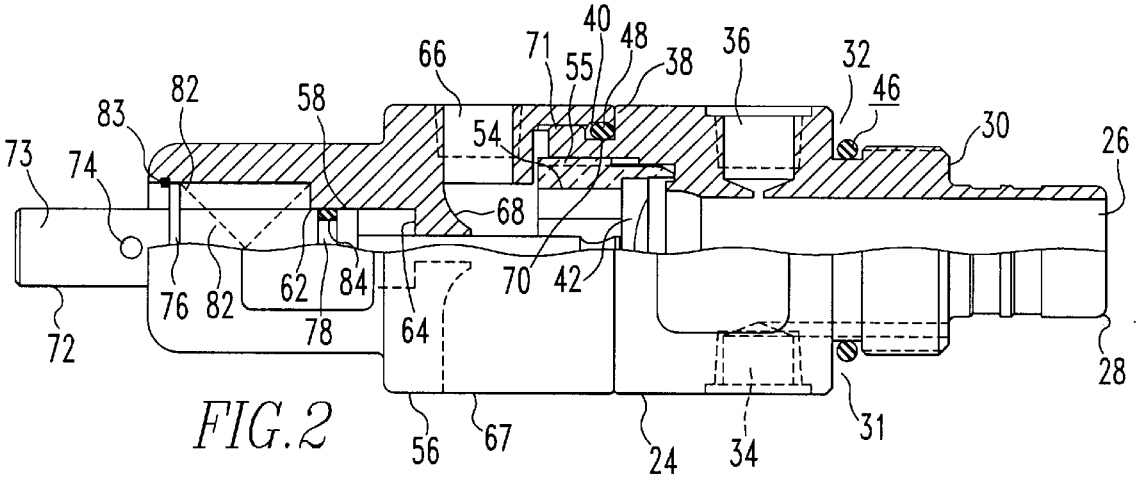
FIG. 2 is a detailed view of the pressure head and activator head elements within area II of FIG.1.

Referring to FIGS. 1–5, the fire extinguisher includes a rigid walled bottle 10. Inside this bottle there is a flexible bladder 12. Inside this bladder there is a fire extinguishing composition or fluid 14. Between the bottle wall and the flexible bladder there is a nitrogen gas charge 16. A drop tube 18 extends axially inside the flexible bladder from its center to its exit 19. A helical drop spring 20 extends from adjacent the exit of the flexible bladder concentrically outside the drop tube to the end of the drop tube and then further toward the opposed end of the flexible bladder. At its terminal end, the drop spring has a spring cap 22. In operation, the spring provides a flexible agent exit chamber during bladder compression and agent discharge. This flexible exit chamber prevents bladder pinching and puncture. Adjacent the exit of the flexible bladder the drop tube engages a pressure head shown generally at numeral 24 and is attached by clamp 25. This pressure head has an axial bore 26 which begins in an end engagement section 28 where the pressure head engages the drop tube and bladder. The pressure head also has shoulders 30 and 31, an O-ring groove 32, a charge valve receiving recess 34 and a gauge receiving recess 36. To its opposed end, the pressure head has another shoulder structure 38 and another O-ring groove 40. Inside the axial bore 26, there is positioned a bore closing disk assembly 42. In O-ring groove 32, O-ring 46 is positioned, and in O-ring groove 40, O-ring 48 is positioned. A charge valve 50 is positioned in charge valve receiving recess 34, and a charge pressure gauge 52 is mounted in gauge receiving recess 36. A nut 54 engaging screw threads 55 retains the bore closing disk assembly 42 in position relative to the pressure head. An activator head is shown generally at numeral 56. This activator head 56 includes an axial bore 58, which has axially spaced inner shoulders 62 and 64. Adjacent the outer shoulder 64, there are discharge orifices 66 and 67 which have curved discharge surfaces as at surface 68. The activator head also has a peripheral longitudinal flange 70 which overlaps O-ring 48 and which is engaged to the pressure head by means of screw threads 71. Inserted in the axial bore of the activator head 58 there is a plunger shown generally at numeral 72. This plunger is comprised of a main body section 73 that has a transverse aperture 74. The body section of the plunger also includes a radial flange 76 and an O-ring groove 78. At the inner end of the plunger there is a firing pin 80. Between the radial flange 76 and the inner shoulder 62 of the activator head there is a spring 82 which presses flange 76 against snap ring 83. O-ring 84 is positioned in O-ring groove 78. At the outer diameter of actuator head 56 there is an explosive charge shown schematically at numeral 86 which is attached via discharge orifice 67 and which may be any suitable commercially available explosive charge product. The explosive charge would be activated in the case of fire by means of a sensor, which is shown schematically at 88, which may be any suitable commercially available fire detector. In operation, a fire inside the vehicle in which the above described device is mounted would be detected by heat sensor 88 which would activate explosive charge 86 which would apply inward burst pressure on disc assembly 42. As a result of such perforation, the fire extinguishing agent would exit the bladder through the drop tube and the axial bores in the pressure head and the axial head and would be released from the device through discharge orifice 66. It would also be possible to manually activate this system by applying an inward axial force F on plunger 70. The firing pin would then be moved axially and inwardly against disk assembly 42 so as to perforate that disk assembly and release the fire extinguishing agent from the bladder.

In an alternative embodiment, the explosive charge and heat sensor could be positioned in axial relation to the plunger 70 as is shown at numerals 86' and 88' respectively. In this alternate embodiment, a fire inside the vehicle in which the device is mounted would be detected by the heat sensor 88' that would activate explosive charge 86' which would apply inward axial pressure on plunger 70. The firing pin would then be moved axially and inwardly against disk assembly 42 so as to perforate that disk assembly. As in the first embodiment, such a perforation would cause the fire extinguishing agent to exit the bladder through the drop tube and the axial bores in the pressure head and the axial head and would be released from the device through discharge orifice 66.

Figure 3:
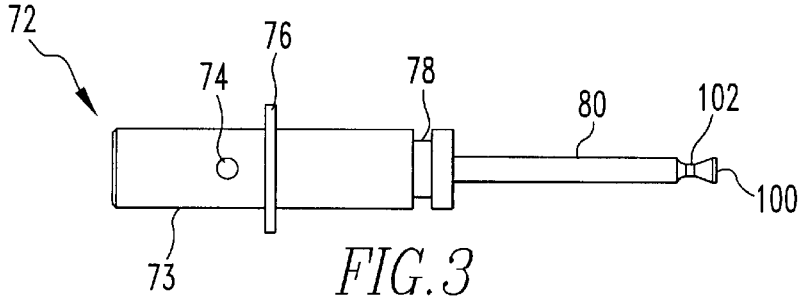
FIG. 3 is a detailed side elevational view of the plunger element used in the fire extinguishing device shown in FIG. 1.
Figure 4:
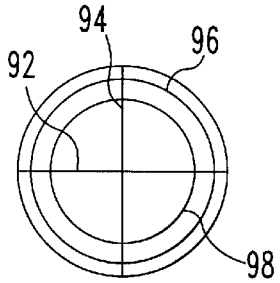
FIG. 4 is a top plan view of a disc assembly used in the fire extinguishing device of the present invention.
Figure 5:
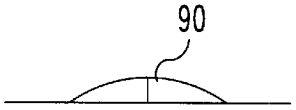
FIG. 5 is a side elevational view of the disc assembly shown in FIG. 4.

Referring to FIGS. 4 and 5, the disc assembly has a domed shaped profile 90. It has dome scores 92 and 94, a pedal score and a hinge area. The disc can be ruptured or perforated by means of an explosive burst or by means of axial plunger motion. The disc is constructed of heat treated nickel alloy with non-intersecting exterior dome surface scores which are perpendicular in location to multiple non-continuous circular pedal scores. In operation, burst or plunger pressure causes dome scores to fracture and resultant agent flow opens disc segments outwardly hinging them at the unscored area of the pedal line. Referring to FIG. 3, the plunger has a flat tip firing pin 96 preceded by an angularly adjacent under cut diameter 98. In operation, movement of the plunger assembly causes contact with the dome of the disc. The flat tip of the firing pin fractures the dome scores and penetrates the disc to a point of minimum undercut diameter. The resultant agent flow through this undercut area causes disc segment fracture.

Figure 6:
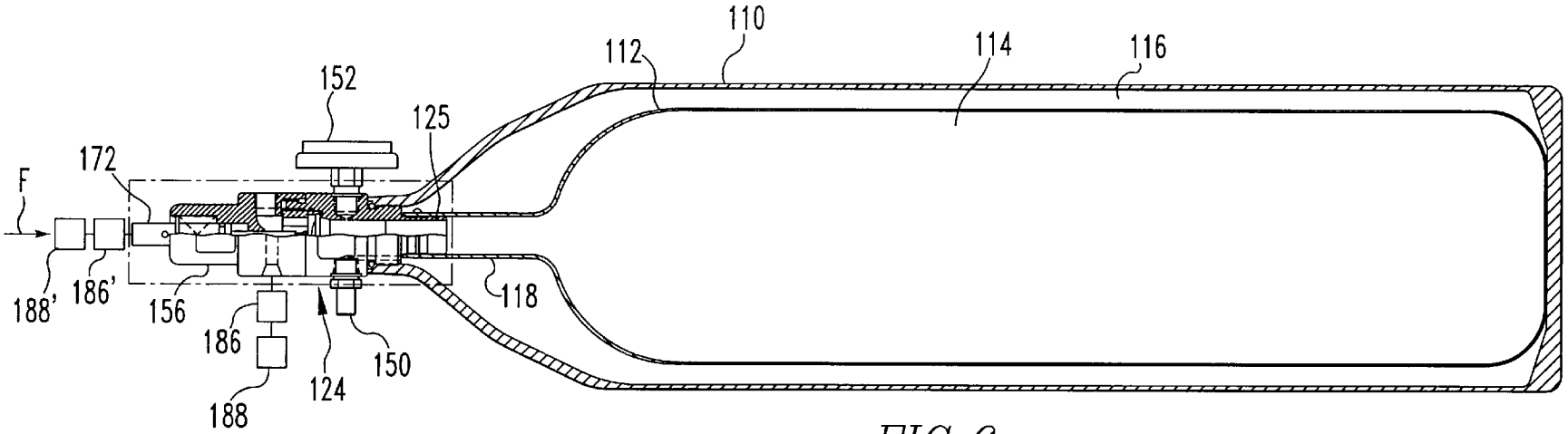
FIG. 6 is a front elevational view substantially in cross section of another preferred embodiment of a fire extinguishing device.
Figure 7:
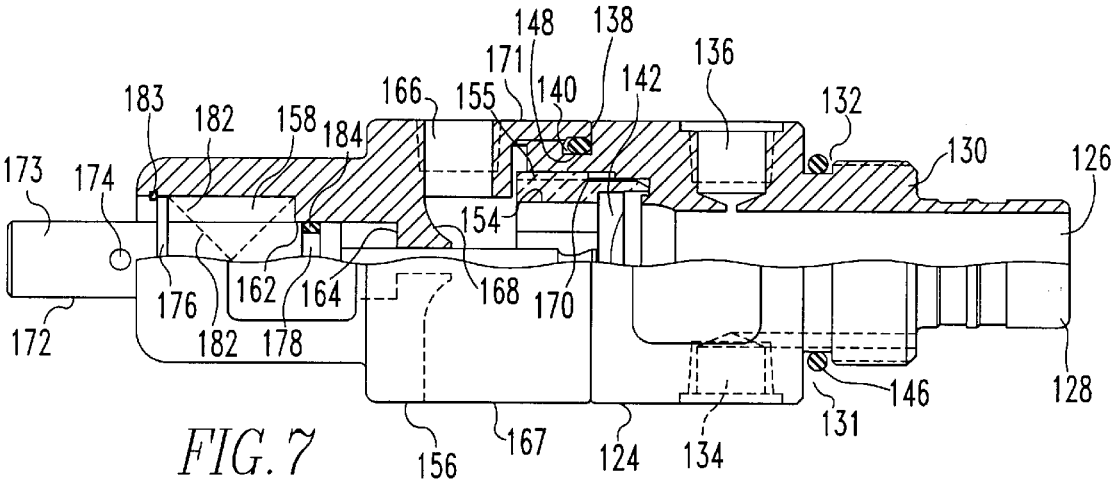
FIG. 7 is a detailed view of the pressure head and activator head elements within area VIII of FIG. 6.

Referring to FIG. 6, another alternate embodiment of the fire extinguisher includes a rigid walled bottle 110. Inside this bottle is a flexible bladder 112. Inside this bladder there is a fire extinguishing composition or fluid 114. Between the bottle wall and the flexible bladder there is a nitrogen gas charge 116. The flexible bladder 112 of this embodiment is comprised of a thermoplastic material, which is preferably urethane. The bladder is flat in its deflated stage. Hence it will not pinch itself off in its body and trap the contained agent. It will only pinch off at the neck so there will be no residual agent in the body. As will be described in greater detail hereafter, the unique character of the design allows for seams that are sealed by RF heat sealing. The thermoplastic material will be compatible with gas agents, and gas agent pressure will preferably be in the range of 21 PSI to 24 PSI at room temperature. Exterior pressure of the bladder is preferably 200 lbs. To 240 lbs. It is desirable that there is pressure on the bladder material and pressure inside the bottle wall. Preferably the thermoplastic material will not expand or will not expand by a significant amount. It is found that when a bladder is expands, such as a latex bladder, is used, there is a clamping of the force that is used to rupture the disc. It is found that the use of a nonexpandable bladder decreases discharge time; for example, a 16 second discharge time is decreased by 3 seconds. This flexible exit chamber prevents bladder pinching and puncture. Adjacent the exit of the flexible bladder 112, the bladder neck 118 connects to a pressure head shown generally at numeral 124 and is attached by clamp 125. This pressure head has an axial bore 126 which begins in an end engagement section 128 where the pressure head engages the bladder. The pressure head also has shoulders 130 and 131, an O-ring groove 132, a charge valve receiving recess 134 and a gauge receiving recess 136. To its opposed end, the pressure head has another shoulder structure 138 and another O-ring groove 140. Inside the axial bore 126, there is positioned a bore closing disk assembly 142. In O-ring groove 132, O-ring 146 is positioned, and in O-ring groove 140, O-ring 148 is positioned. A charge valve 150 is positioned in charge valve receiving recess 134, and a charge pressure gauge 152 is mounted in gauge receiving recess 136. A nut 154 engaging screw threads 155 retains the bore closing disk assembly 142 in position relative to the pressure head. An activator head is shown generally at numeral 156. This activator head 156 includes an axial bore 158, which has axially spaced inner shoulders 162 and 164. Adjacent the outer shoulder 164, there are discharge orifices 166 and 167 which have curved discharge surfaces as at surface 168. The activator head also has a peripheral longitudinal flange 170 which overlaps O-ring 148 and which is engaged to the pressure head by means of screw threads 171. Inserted in the axial bore of the activator head 158 there is a plunger shown generally at numeral 172. This plunger is comprised of a main body section 173 that has a transverse aperture 174. The body section of the plunger also includes a radial flange 176 and an O-ring groove 178. At the inner end of the plunger there is a firing pin 180. Between the radial flange 176 and the inner shoulders 62 of the activator head there is a spring 182 which presses flange 176 against snap ring 183. O-ring 184 is positioned in O-ring groove 178. At the outer diameter of actuator head 156 there is an explosive charge shown schematically at numeral 186 which is attached via discharge orifice 167 and which may be any suitable commercially available explosive charge product. The explosive charge would be activated in the case of fire by means of a sensor, which is shown schematically at 188, which may be any suitable commercially available fire detector. In operation, a fire inside the vehicle in which the above described device is mounted would be detected by heat sensor 188 that would activate explosive charge 186 which would apply inward burst pressure on disk assembly 142. As a result of such perforation, the fire extinguishing agent would exit the bladder 112 through the drop tube 118 and the axial bore 126 in the pressure head 124 and the axial head 126 and would be released from the device through discharge orifice 166. It would also be possible to manually activate this system by applying an inward axial force F on plunger 172. The firing pin would then be moved axially and inwardly against disk assembly 142 so as to perforate that disk assembly and release the fire extinguishing agent from the bladder.

In another alternative embodiment, the explosive charge and heat sensor could be positioned in axial relation to the plunger 70 as is shown at numerals 186' and 188' respectively. In this alternate embodiment, a fire inside the vehicle in which the device is mounted would be detected by the heat sensor 188', which would activate explosive charge 186', which would apply inward axial pressure on plunger 170. The firing pin would then be moved axially and inwardly against disk assembly 142 so as to perforate that disk assembly. As in the first embodiment, such a perforation would cause the fire extinguishing agent to exit the bladder through the drop tube and the axial bores in the pressure head and the axial head and would be released from the device through discharge orifice 166.

The firing pin and the disc assembly and their operation for the embodiment shown in FIGS. 7–10 is essentially identical to the firing pin and disc assembly shown in FIGS. 3 and 4–5 respectively.

Figure 10:
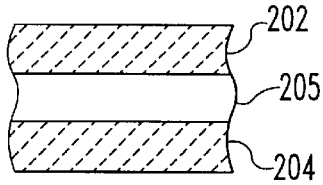
FIG. 10 is an enlarged view of circle IX in FIG. 8.
Figure 11:
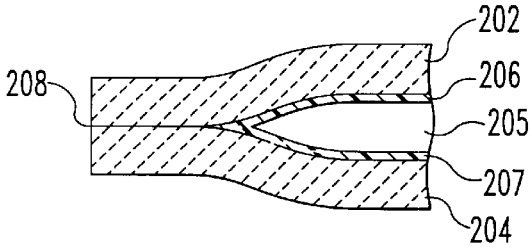
FIG. 11 is a cross section through X—X in FIG. 6.
Figure 8:
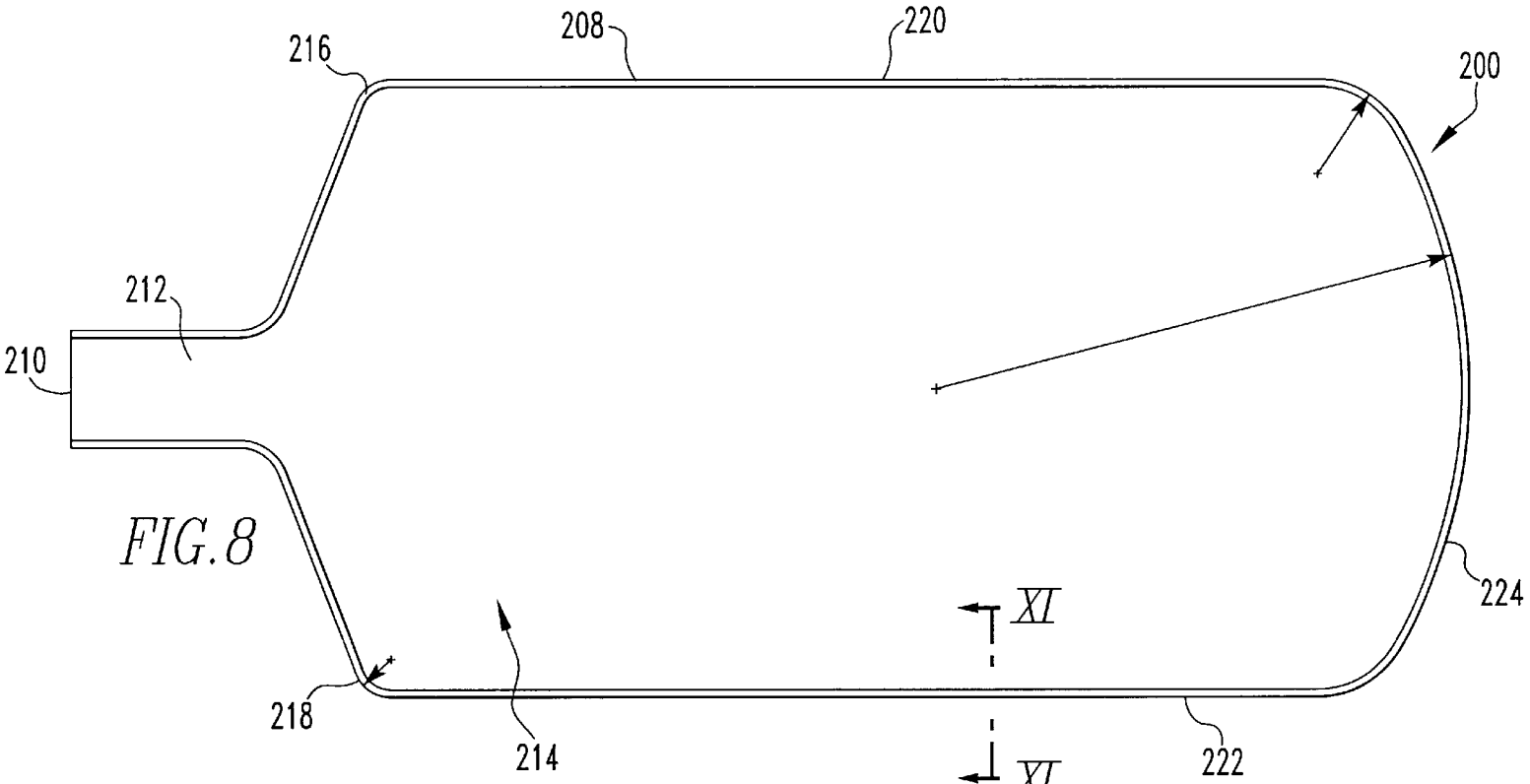
FIG. 8 is a top plan view of a preferred embodiment of the flexible bladder of the present invention that is similar to the flexible bladder used in the fire extinguishing device shown in FIG. 6.
Figure 9:
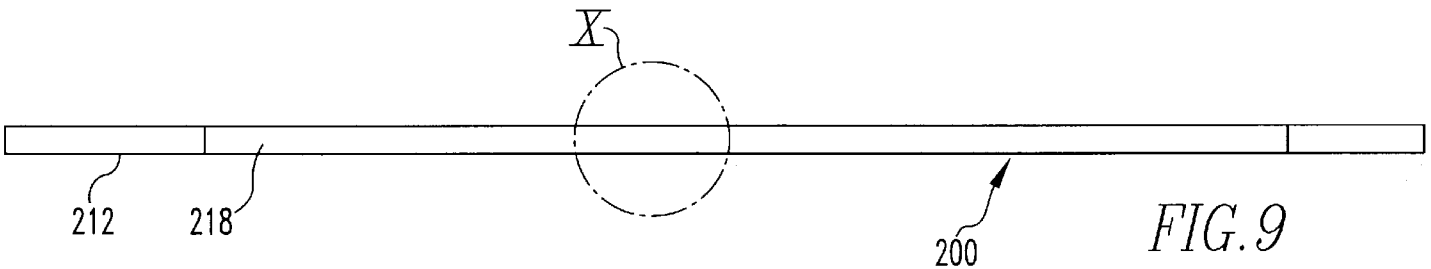
FIG. 9 is a side view of the bladder shown in FIG. 8.

Referring to FIGS. 8–11, a bladder similar to the one shown in FIG. 6 is shown generally at numeral 200. Referring particularly to FIGS. 10–11, this bladder is made of an upper fabric layer 202 and a lower fabric layer 204 with a fire extinguishing composition space 205 between these fabric layers. Preferred fire extinguishing compositions include FIRE X PLUS—GEL FOAM—FE-36. Each of these fabric layers 202 and 204 has an inner gas impermeable coated surface respectively at surfaces 206 and 207. Connecting the two fabric layers 202 and 204 there is a peripheral heat seal 208. This peripheral heat seal surrounds the entire bladder except at a front opening 210, which is at the front terminal end of a front neck 212. Forwardly from this front neck there is the composition containing body 214. This body 214 has a pair of front shoulders 216 and 218. Rearwardly from these shoulders there are respectively longitudinal edges 220 and 222. At the rear of the bottle there is a radial edge 224, which has a major radius $R_1$. The corners of the bladder 200 also have minor radii $R_2$ and $R_3$.

The manufacture of the bladder is further described with reference to the following example.

EXAMPLE

The bladder material is die cut from sheet stock with a cutting die. Two die cut bladder components are overlaid each other in a sealing die cradle. The sealing die is pre-heated to 150° F. Pressure is applied to the die sealing unit and the bladder components at a rate of 85 lb. PSI, for a pre-seal time of one second. At the conclusion of the pre-seal cycle time, a radio frequency of 27.12 MEG is generated at the die sealing blades for a cycle time of four seconds. The sealing die remains under pressure for an additional one second cooling cycle period, before the sealed bladder is removed form the die cradle.

It will be appreciated that a fire extinguishing device has been provided which allows for relatively simple and inexpensive construction and which may be efficiently activated to effectively suppress or extinguish vehicular fires.

While the present invention has been described in connection with the preferred embodiments of the various figures, it is to be understood that other similar embodiments may be used or modifications and additions may be made to the described embodiment for performing the same function of the present invention without deviating therefrom. Therefore, the present invention should not be limited to any single embodiment, but rather construed in breadth and scope in accordance with the recitation of the appended claims.

What is claimed is:

1. A fire extinguishing or suppressing device comprising:

a rigid vessel having and interior space and an exit means;

a substantially unexandable flexible bladder having an inflated stage and a deflated stage positioned in the interior space of the rigid vessel forming a space between the flexible bladder and the rigid vessel, wherein said flexible bladder is substantially flat in said deflated stage;

a fire extinguishing composition contained within the flexible bladder; and a pressurized gas interposed between the rigid vessel and the flexible bladder.

2. The device of claim 1 wherein the fire extinguishing composition is a fluid.

3. The device of claim 2 wherein the pressurized vessel has a fire extinguishing fluid exit means and between said exit means and the fire composition containment means there is a fluid conveying means.

4. The device of claim 3 wherein the pressurized vessel has a transverse aperture for pressure relief.

5. The device of claim 4 wherein the means for retaining the fire extinguishing composition in the vessel is a means for closing the pressurized fluid conveying means.

6. The device of claim 5 wherein the pressurized fluid conveying means is an axial bore and the means for closing the pressurized fluid conveying means is a disk transversely positioned across said axial bore.

7. The device of claim 6 wherein the means for deactivating the means for retaining the fire extinguishing composition in the vessel is a means for perforating the disk transversely positioned across the axial bore.

8. The device of claim 7 wherein the means for perforating the disc transversely positioned across the axial bore is an explosive means.

9. The device of claim 8 wherein the explosive means is activated in response to the detection of a fire.

10. The device of claim 7 wherein the means for perforating the disk is a pin aligned with the axial bore.

11. The device of claim 10 wherein means are provided to move the pin axially to perforate the disk.

12. The device of claim 11 wherein the means for moving the pin axially is an explosive means.

13. The device of claim 11 wherein the means for moving the pin axially is a manual means.

14. The device of claim 1 wherein the bladder is comprised of a noncorrosive material.

15. The device of claim 1 wherein the pressurized gas is nonreactive.

16. The device of claim 15 wherein the pressurized gas is nitrogen.

17. The device of claim 1 wherein the flexible bladder is comprised of:

a base first planar section having a peripheral edge;

a second planner section superimposed over the first planar section and having a peripheral edge;

means for fixing the first planar section to the second planar section at their respective peripheral edges; and means for allowing egress of the fire extinguishing composition.

18. The device of claim 17 wherein the first and second planar sections are comprised of a fabric.

19. The device of claim 18 wherein the first and second planar elements are gas impermeable.

20. The device of claim 19 wherein the first and second bladders have interior gas permeable coatings.

21. The device of claim 17 wherein the means for fixing the first and second planar sections at their peripheral edges is a peripheral heat seal.

22. The device of claim 21 wherein there is a gap in the peripheral heat seal and said gap comprises the means for allowing egress of the fire extinguishing composition.

23. The device of claim 22 wherein the bladder has a forward neck having a forward terminal end and the means for allowing egress of the fire extinguishing composition is at the forward terminal end of said neck.

24. The device of claim 23 wherein the bladder has a body having shoulders in rearward relation to said neck.

25. The device of claim 24 wherein said body has a rearward curved edge in opposed relation to said neck.

26. The device of claim 23 wherein the bladder has longitudinal sides between the shoulders and said curved rearward edge.

27. A fire extinguishing or suppressing device comprising:

a rigid vessel having an interior space, an exit means, an axial bore extending between said interior space and said exit means, and a disk transversely positioned across the axial bore;

a substantially unexpandable flexible bladder positioned in the interior space of the rigid vessel forming a space between the flexible bladder and the rigid vessel;

a fluid fire extinguishing composition contained within the flexible bladder;

a pressurized gas interposed between the rigid vessel and the flexible bladder.

28. The fire extinguishing or suppressing device of claim 27 wherein the axial bore is a fluid conveying means between the flexible bladder and the exit means which is closed by the disk, and wherein there is a means for perforating the disk to allow release of the fluid fire extinguishing composition from the flexible bladder, through the axial bore and out the exit means.

29. The device of claim 28 wherein the means for perforating the disk is a pin aligned with the axial bore.

30. The device of claim 29 wherein the pin is moved axially to perforate the disk by an explosive means.

31. The device of claim 29 wherein the pin is moved axially to perforate the disk by a manual means.

32. The device of claim 27 wherein the substantially unexpandable flexible bladder has an inflated stage and a deflated stage and said flexible bladder is substantially flat in said deflated stage.

33. A vehicular fire extinguishing or suppressing device comprising:

a pressurized vessel comprising an outer rigid walled bottle and an internal flexible compressible bladder with a pressurized gas interposed between said rigid walled bottle and said internal flexible compressible bladder, and said vessel having an exit means and said internal flexible compressible bladder having a tube extending axially therein and containing a fire extinguishing composition therein;

an axial bore connecting the tube in the fire extinguishing composition containing internal flexible compressible bladder and the exit means and a disk, wherein said disk is comprised of nickel alloy and is transversely positioned across the axial bore to restrain release of the fire extinguisher composition from the internal flexible compressible bladder; and a disk penetrating means comprising a pin which is positioned in the axial bore and is aligned with the disk, whereby the pin is movable with force manually or by an explosive charge means in the axial bore so that the pin penetrates the disk to allow the pressurized gas interposed between the rigid walled bottle and the internal flexible compressible bladder to expel fire extinguishing composition from the internal flexible expandable bladder first through the tube and then through the axial bore and then through the exit means, so that said expelling of the fire extinguishing composition may be accomplished regardless of vehicular position.

34. The fire extinguishing or suppressing device of claim 33 wherein the pin has a flattened tip.

35. The fire extinguishing or suppressing device of claim 34 wherein the disk is dome shaped.

36. The entire extinguishing or suppressing device of claim 35 wherein the disk is scored.

37. The fire extinguishing or suppressing device of claim 33 further comprising a helical spring which coaxially surrounds the tubular fluid conveying means.

38. A vehicular fire extinguishing or suppressing device comprising:

a pressurized vessel having an exit means and an internal bladder having a tube extending axially therein and containing a fire extinguishing composition, wherein said bladder is comprised of a flexible compressible noncorrosive material and said pressurized vessel has a rigid wall and a pressurized non-reactive gas is interposed between the rigid wall of the vessel and the flexible bladder;

an axial bore connecting the tube of the fire extinguishing composition containing bladder and the exit means and a disk comprised of a nickel alloy which is transversely positioned across the axial bore to close said axial bore to restrain release of the fire extinguishing composition; and a disk penetrating means comprising a narrow elongated member which is positioned in the axial bore and is aligned with the disk, whereby the elongated member is movable with force manually or by an explosive charge in the axial bore so that the elongated member first fractures and then penetrates the disk to allow release of the fire extinguishing composition from the bladder first through the tube and then through the axial bore and then through the exit means, so that said expelling of the fire extinguishing composition may be accomplished regardless of vehicular position.

39. The fire extinguishing or suppressing device of claim 38 wherein the elongated member has a flattened tip.

40. The fire extinguishing or suppressing device of claim 39 wherein the disk is dome shaped.

41. The fire extinguishing or suppressing device of claim 40 wherein the disk is scored.

42. The fire extinguishing or suppressing device of claim 38 further comprising a helical spring which coaxially surrounds the tube.

43. A vehicular fire extinguishing or suppressing device comprising:

a pressurized vessel having an exit means and an internal bladder having a tubular fluid conveying means extending axially therein and containing a fire extinguishing composition;

an axial bore connecting the tubular fluid conveying means in the fire extinguishing composition containing bladder and the exit means and a disk shaped seal comprised of a nickel alloy transversely positioned across the axial bore to close said axial bore to restrain release of the fire extinguishing composition; and a disk penetrating means comprising a pin positioned in the axial bore which is aligned with the disk and means for applying an axial force manually or by an explosive charge on the pin whereby said means for applying an axial force on the pin causes the pin to move in the axial bore to penetrate the seal to allow release of the fire extinguishing composition from the bladder first through the interior tubular fluid conveying means and then through the axial bore and then through the exit means, so that said expelling of the fire extinguishing composition may be accomplished regardless of vehicular position.

44. The fire extinguishing or suppressing device of claim 43 wherein the pin has a flattened tip.

45. The fire extinguishing or suppressing device of claim 44 wherein the disk is dome shaped.

46. The entire extinguishing or suppressing device of claim 45 wherein the disk is scored.

47. The fire extinguishing or suppressing device of claim 35 further comprising a helical spring which coaxially surrounds the tube.

* * * * *